United States Patent [19]

Garbell

[11] 4,425,739

[45] Jan. 17, 1984

[54] SLIDING PANEL WITH SOUND-TRAP FRAMING

[76] Inventor: Maurice A. Garbell, P.O. Box 948, San Francisco, Calif. 94104

[21] Appl. No.: 302,697

[22] Filed: Sep. 15, 1981

Related U.S. Application Data

[63] Continuation of Ser. No. 104,414, Dec. 17, 1979, abandoned.

[51] Int. Cl.[3] ..... E05B 7/16

[52] U.S. Cl. ..... 49/424; 98/88 R; 49/404

[58] Field of Search ..... 49/424, 404; 98/88 R; 52/144, 207

[56] References Cited

U.S. PATENT DOCUMENTS 209,073 10/1878 Phillips ..... 49/404
3,165,165 1/1965 Chapman ..... 49/424 X

FOREIGN PATENT DOCUMENTS 490796 8/1938 United Kingdom ..... 98/88 R
1121794 7/1968 United Kingdom ..... 49/404

*Primary Examiner*—Philip C. Kannan
*Attorney, Agent, or Firm*—Ernest M. Anderson

[57] ABSTRACT

Means providing a sound trap along one edge of a sliding panel and comprising a pair of substantially parallel and transversely spaced-apart wall members extending longitudinally from a panel stop. The space between wall members, in turn, provides a transverse gap spacing between the panel and each wall member, the longitudinal extension of said wall members from the stop being approximately two and one-half times the transverse gap spacing between the panel and the wall members. The sound trap thus provided allows the panel to be moved from a position of closure against the stop to a position that provides a gap distance opening between wall members with an overlap one and one-half times the gap spacing.

2 Claims, 5 Drawing Figures

SLIDING PANEL WITH SOUND-TRAP FRAMING

This is a continuation of application Ser. No. 104,414, filed Dec. 17, 1979, abandoned.

SUMMARY OF THE INVENTION

This invention relates generally to the mitigation or attenuation of sound penetration, while permitting ventilation and the passage of air into an enclosure. The problems of sound or noise penetration, it will be understood, are particularly severe in residential communities and dwellings adjacent to roads, railroads, airports, and industrial parks. Conventional sliding windows or glass doors, when left open for ventilation, allow noise to enter. This fact is well recognized and, in many residential areas where exterior noises are prevalent, sliding windows and glass doors are equipped with extra-thick or multilayer panels which are capable of significant sound reduction so long as they remain closed. However, during the summer months, or in regions where the air temperatures are exceedingly high during the day, it is necessary to rely on central forced air ventilation if the doors and windows are to remain closed.

The operation of a central forced air-ventilation system is energy-consuming and by itself may produce objectionable blower noises. Thus, in residential communities, many people prefer to open their windows notwithstanding the penetration of exterior noise into their dwellings. It must be understood that even a small aperture or gap between a sliding panel and its complementary stop or jamb results in an appreciable increase in the interior noise levels attributable to a prevailing exterior noise.

The drawbacks characteristic of conventional jambs, sliding doors and windows, as well as other types of windows and doors, have been recognized by others, and various kinds of sound-baffling devices have been created. Exemplary teachings of the prior art as related to this invention are disclosed in U.S. Pat. Nos. 1,108,613, 1,611,483, 1,990,520, and 2,225,809.

In brief, the present invention teaches the construction of a novel frame for sliding panels, such as a door or window, said frame comprising a pair of parallel and transversely spaced-apart sound-inhibiting wall members. Each wall member extends longitudinally from a panel stop or jamb parallel to the sliding panel. Together, the wall members define a space therebetween for receiving the sliding panel.

The spacing between wall members provides a substantial gap between the panel and each wall member; and, in the preferred construction, the longitudinal extension of each wall member from the panel stop is at least two and one-half times the transverse gap spacing between the panel and the wall members. This construction, it has been found, allows the panel to be moved into a position which provides a substantial opening between the end of the panel and a panel stop and yet allows the panel to remain disposed between the wall members. The longitudinal overlap distance between the edge of the sliding panel and the ends of the parallel and spaced-apart wall members affords the creation of an effective sound trap through which outside air may be admitted into an otherwise enclosed room.

It is to be understood that the primary object of the present invention is to provide a novel sound trap for use with conventional sliding panels as currently employed in residential buildings.

Other objects of this invention will become apparent in view of the following detailed description.

In the drawings forming a part of this application and in which like parts are identified by like numerals;

Figure 1:
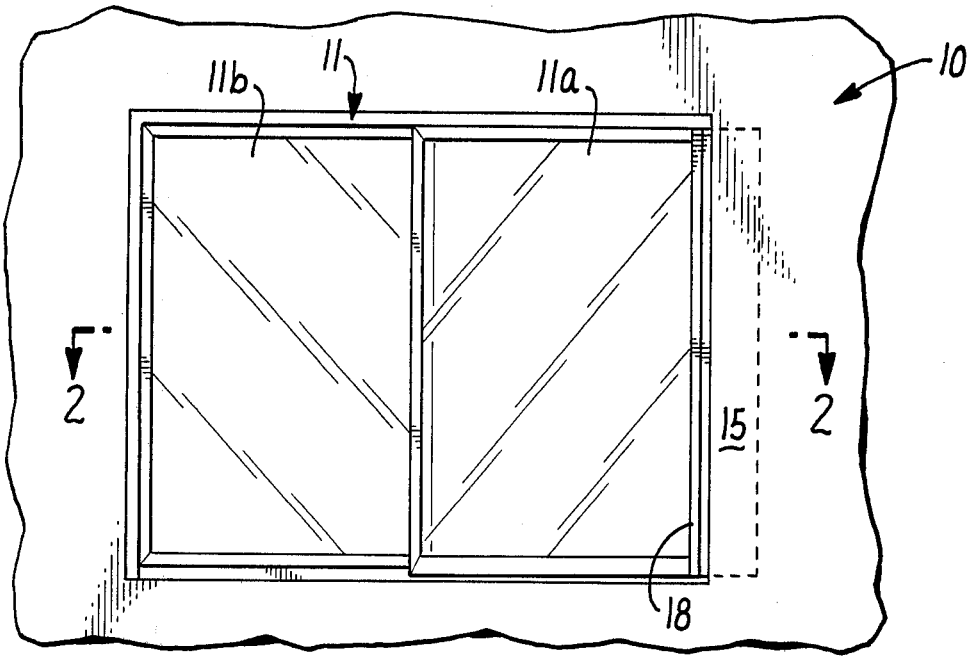
FIG. 1 is an elevation of one portion of a wall including a conventional sliding window or sliding door mounted in a frame and constructed as one preferred embodiment of this invention.
Figure 2:
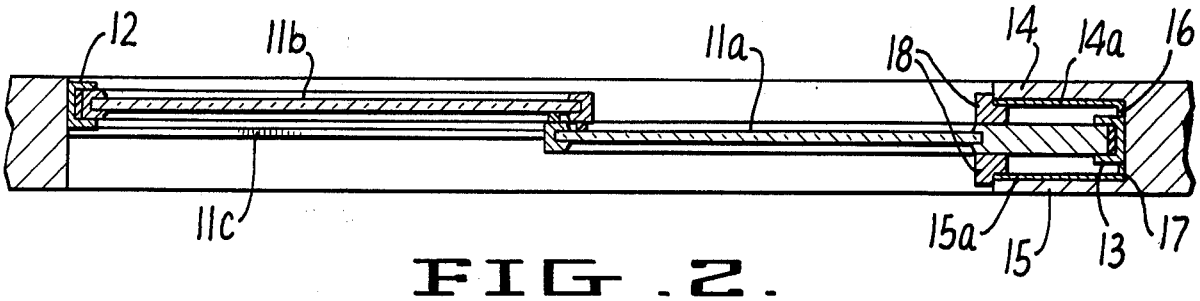
FIG. 2 is a transverse horizontal section taken on the line 2—2 of FIG. 1.
Figure 3:
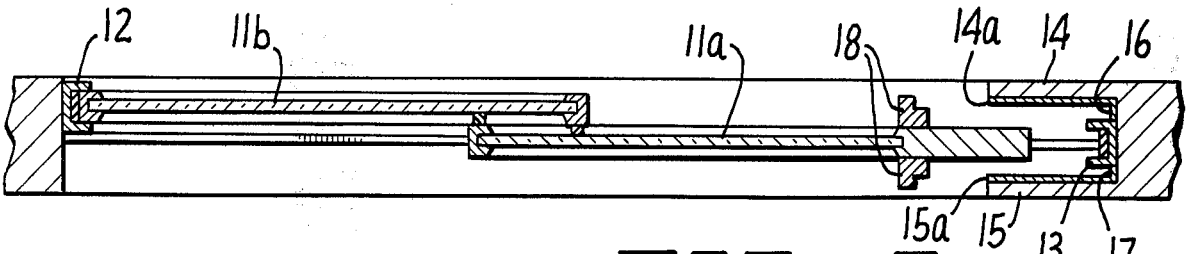
FIG. 3 is a section of the window shown in FIG. 2, but with the sliding portion in an open position utilizing the sound-trap feature provided by the frame.

Referring to FIGS. 1 and 2 of the drawings in particular, there is shown a wall 10 including a window or door 11 having a sliding panel 11*a* and a fixed panel 11*b*. Panel 11*b* is mounted on a track or guide rail 11*c* allowing the panel to be slid longitudinally in front of or behind panel 11*b* (depending on the side from which the window is viewed). The outside vertical edge of panel 11*a* is also adapted to be received in a jamb 13 which is of conventional design and functions as a stop and air seal. However, it will be noted that the edge of panel 11*a*, which in FIG. 2 is shown received in channel 13, may be positioned between a pair of parallel and transversely spaced-apart sound-inhibiting wall members, 14 and 15. Each wall member extends longitudinally from stop 13 parallel to sliding panel 11*a*.

Figure 4:
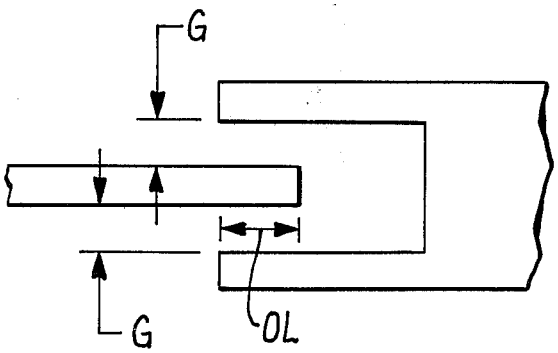
FIG. 4 is a diagrammatic view and detail with reference to specific dimensional relationships required to practice the invention effectively.
Figure 5:
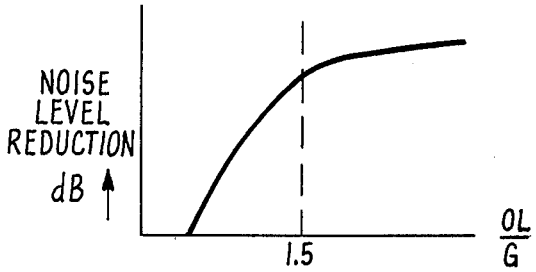
FIG. 5 is a graph illustrating the level of noise reduction which has been determined based on the dimensional relationships shown in FIG. 4.

The space between wall members provides a transverse gap spacing G between the panel 11*a* and each wall member, as is best shown in FIG. 4. The longitudinal extension of wall members 14 and 15 from stop 13, in the preferred embodiment, is at least two and one-half times the gap spacing G. This dimensional relationship provides an overlap distance OL equal to one and one-half times G when the opening between panel 11*a* and stop 13 is also a distance G. The gap spacing G may be approximately one to two inches, or greater. Such spacing ensures adequate air ventilation around the vertical edge of panel 11*a* and wall members 14 and 15.

FIG. 4 illustrates a graph based on information obtained by varying the overlap distance OL relative to the gap spacing G. It has been observed that the noise-level reduction rapidly increases as the ratio OL:G increases from 0.5 to 1.5. At OL:G ratios exceeding 1.5, there is a moderate further increase in noise-level reduction. Thus, optimum ventilation and effective noise reduction suggest that the ratio OL:G be approximately 1.5 or greater.

In the preferred embodiment shown, the interior panel faces 14*a* and 15*a* of wall members 14 and 15 are lined with a sound-absorbing acoustical material such as a fiberglass or vinyl product. Interior surfaces 16 and 17, located on opposite sides of channel 13, may be lined similarly. In addition, a pair of sealing strips 18 are mounted to opposite sides of panel 11*a*. Sealing strips 18 are located on panel 11*a* so as to engage with the ends of wall panels 14 and 15 when panel 11*a* is positioned into engagement with stop 13.

Although a preferred embodiment of the invention has been illustrated and described, various modifications and changes may be resorted to without departing from the spirit of the invention or the scope of the appended claims, and each of such modifications and changes is contemplated.

What is claimed is:

1. In combination with a vertical, horizontally slidable panel that is reciprocally movable and engageable with a vertical bar stop or jamb at a position of closure, a sound guard comprised of a pair of parallel and transversely spaced-apart sound-inhibiting wall members, said wall members extending horizontally from said vertical bar stop parallel to said sliding panel for receiving said panel therebetween, the space between wall members providing a transverse gap spacing between said panel and each wall member, the horizontal extension of each wall member from said bar stop being at least two and one-half times the transverse gap spacing between said panel and wall members; and a pair of sealing-strip means mounted on opposite sides of said panel and engageable with the ends of said wall members, respectively, when said panel is slidably positioned into engagement with said bar stop, whereby said panel may be moved horizontally into a position to provide a substantial opening around the end of said panel and between said panel and said bar stop while positioned between said wall members.

2. The combination of claim 1 wherein the gap spacing between each wall member and panel is approximately one inch or greater, and said pair of sealing-strip means are located approximately $2\frac{1}{2}$ inches or greater from the edge of said panel that is engageable with said bar stop.

* * * * *